US009719471B2

(12) United States Patent
Ohm et al.

(10) Patent No.: US 9,719,471 B2
(45) Date of Patent: Aug. 1, 2017

(54) FUEL INJECTION VALVE FOR INTERNAL COMBUSTION ENGINES

(71) Applicant: Robert Bosch GmbH, Stuttgart (DE)

(72) Inventors: Andreas Ohm, Kupferzell (DE); Christian Wehr, Heilbad Heiligenstadt (DE); Christian Kanka, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 2 days.

(21) Appl. No.: 14/901,552

(22) PCT Filed: Jun. 18, 2014

(86) PCT No.: PCT/EP2014/062893

§ 371 (c)(1),
(2) Date: Dec. 28, 2015

(87) PCT Pub. No.: WO2014/206851

PCT Pub. Date: Dec. 31, 2014

(65) Prior Publication Data

US 2016/0230721 A1 Aug. 11, 2016

(30) Foreign Application Priority Data

Jun. 26, 2013 (DE) ..... 10 2013 212 269

(51) Int. Cl.
*F02M 47/02* (2006.01)
*F02M 61/10* (2006.01)
*F02M 61/20* (2006.01)

(52) U.S. Cl.
CPC ..... *F02M 47/025* (2013.01); *F02M 47/027* (2013.01); *F02M 61/10* (2013.01);
(Continued)

(58) Field of Classification Search
CPC .... F02M 47/025; F02M 47/027; F02M 61/10; F02M 61/12; F02M 61/20; F02M 2200/50; F02M 2547/001
USPC ..... 239/533.9, 88–92, 533.1–533.15, 96; 251/5, 172, 175
See application file for complete search history.

(56) References Cited

U.S. PATENT DOCUMENTS 3,610,529 A 10/1971 Huber
6,705,551 B1 * 3/2004 Kienzler ..... F02M 47/02 239/533.11

(Continued)

FOREIGN PATENT DOCUMENTS

DE 102004005451 8/2005
DE 102005020359 11/2006

(Continued)

OTHER PUBLICATIONS

International Search Report for Application No. PCT/EP2014/062893 dated Sep. 2, 2014 (English Translation, 3 pages).

*Primary Examiner* — Arthur O Hall
*Assistant Examiner* — Juan C Barrera
(74) *Attorney, Agent, or Firm* — Michael Best & Friedrich LLP

(57) ABSTRACT

The invention relates to a fuel injection valve, comprising a nozzle body (1) and a pressure chamber (3) formed therein, wherein the pressure chamber (3) can be filled with fuel under high pressure and wherein a piston-shaped nozzle needle (5) is arranged in the pressure chamber so as to be movable longitudinally, which nozzle needle interacts with a nozzle seat (7) formed in the nozzle body (1) by means of a sealing surface (6) formed at the end of the nozzle needle on the combustion chamber side and thereby controls the flow of fuel from the pressure chamber (3) to at least one injection opening (8). A sleeve (12) accommodates the end of the nozzle needle (5) facing away from the nozzle seat and bounds a control chamber (20). By means of the pressure of the control chamber, a hydraulic force is applied to the nozzle needle (5) in the direction of the nozzle seat (7). A closing spring (16) is arranged in the control chamber (20). The closing spring is arranged between the sleeve (12) and the nozzle needle (5) under compressive preload.

3 Claims, 2 Drawing Sheets

Figure 1:
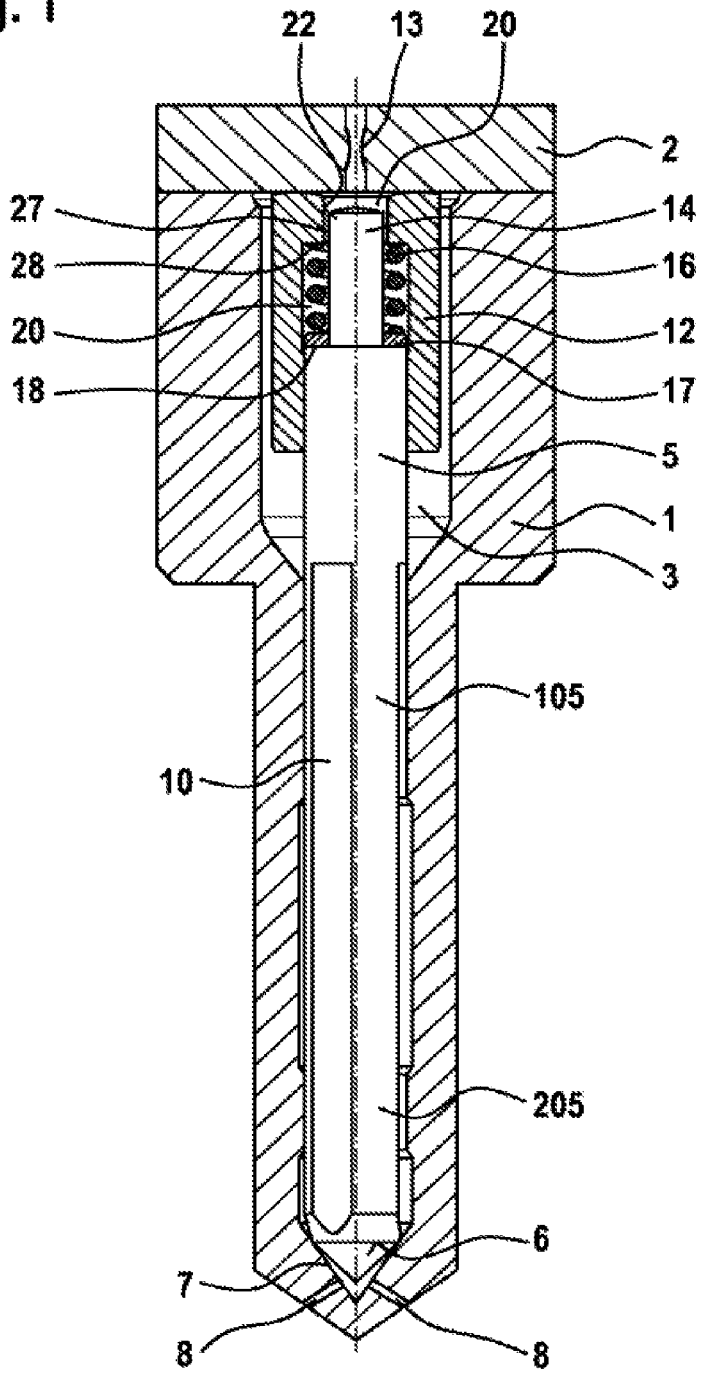

(52) U.S. Cl.
CPC ..... *F02M 61/20* (2013.01); *F02M 2200/50* (2013.01); *F02M 2547/001* (2013.01)

(56) References Cited

U.S. PATENT DOCUMENTS

| | | | | |
|---|---|---|---|---|
| 6,988,680 | B1 * | 1/2006 | Boecking | F02M 47/027 239/533.3 |
| 7,963,464 | B2 * | 6/2011 | Lewis | F02M 47/027 239/533.11 |
| 8,226,018 | B2 * | 7/2012 | Magel | F02M 47/027 239/533.2 |
| 2003/0015599 | A1 * | 1/2003 | Carroll, III | F02M 45/086 239/88 |
| 2011/0088660 | A1 | 4/2011 | Gruenberger | |

FOREIGN PATENT DOCUMENTS

| | | |
|---|---|---|
| DE | 102006012842 | 9/2007 |
| DE | 102008001330 | 10/2009 |
| EP | 1598551 | 11/2005 |
| EP | 1630406 | 3/2006 |
| JP | 2002322970 | 11/2002 |
| JP | 2011185223 | 9/2011 |

* cited by examiner

FUEL INJECTION VALVE FOR INTERNAL COMBUSTION ENGINES

BACKGROUND OF THE INVENTION

The invention relates to a fuel injection valve for internal combustion engines, such as is used for the injection of fuel into combustion chambers of fast-running auto-ignition internal combustion engines.

Fuel injection valves, such as are suitable for injecting fuel at high pressure into combustion chambers of internal combustion engines, are known for example from DE 10 2008 001 330 A1. Such fuel injection valves have a valve body in which there is arranged a longitudinally displaceable, piston-like valve needle. The compressed fuel, which is made available in a central high-pressure accumulator connected to the fuel injection valve, is introduced via multiple injection openings into a combustion chamber, wherein the nozzle needle opens and closes the injection openings. The longitudinal movement of the nozzle needle is controlled by way of the fuel pressure in a control chamber. The control chamber acts on that end of the nozzle needle which is averted from the valve seat, such that a closing force is exerted on the nozzle needle by the fuel pressure in the control chamber. By way of a control valve, the fuel pressure in the control chamber can be adjusted, such that the nozzle needle moves in a longitudinal direction in accordance with said pressure.

During the operation of the fuel injection valve, a high fuel pressure prevails at all times in the control chamber and also in the pressure chamber that surrounds the nozzle needle. When the internal combustion engine is shut down, however, said fuel pressure decreases to ambient pressure, such that the hydraulic closing force on the nozzle needle is eliminated, and the latter possibly opens in uncontrolled fashion. To prevent this, there is provided within the pressure chamber a closing spring which surrounds the nozzle needle and which, by way of its compressive preload, holds the nozzle needle in its closed position, even when the fuel pressure in the fuel injection valve has fallen to ambient pressure. In order that the closing spring can transmit the force optimally to the nozzle needle, there is formed on the outer side of the nozzle needle a shoulder against which a spring plate bears, with the closing spring resting in turn on said spring plate and thus exerting the closing force on the nozzle needle. The nozzle needle must therefore be equipped with a corresponding diameter step, which complicates the production process and thus increases production costs. Furthermore, the spring requires an adequate structural space in the pressure chamber, which limits a miniaturization of the fuel injection valve.

SUMMARY OF THE INVENTION

The fuel injection valve according to the invention has, in relation to this, the advantage that a compact and simple construction of the nozzle needle is made possible, without an impairment of functionality in relation to the known fuel injection valve. For this purpose, the fuel injection valve has a nozzle body with a pressure chamber formed therein, wherein the pressure chamber can be charged with fuel at high pressure. A piston-like nozzle needle is arranged in longitudinally displaceable fashion in the pressure chamber, which nozzle needle interacts, by way of a sealing surface formed on its combustion chamber-side end, with a nozzle seat formed in the nozzle body. In this way, the nozzle needle controls the flow of fuel from the pressure chamber to at least one injection opening. Furthermore, a sleeve is provided which receives that end of the nozzle needle which is averted from the nozzle seat, which sleeve delimits a control chamber, the pressure of which exerts a hydraulic force on the nozzle needle in the direction of the nozzle seat. In the control chamber there is arranged a closing spring which is arranged under compressive preload between the sleeve and the nozzle needle.

Since no shoulder is required on the outer side of the nozzle needle for the closing spring in order to transmit the closing force to the nozzle needle, the nozzle needle can be provided with a uniform diameter on the outer circumference over practically its entire length, which simplifies the production process, thus making it cheaper. Furthermore, the assembly composed of the sleeve, the closing spring and the nozzle needle can be assembled in a separate process, and then introduced as a whole into the nozzle body, wherein the closing spring remains protected within the sleeve, and thus cannot be damaged during the assembly process.

In a first advantageous refinement of the invention, the closing spring exerts a closing force on the nozzle needle in the direction of the nozzle seat, while said closing spring furthermore presses the sleeve against a throttle disk which delimits the control chamber. In this way, the force of the closing spring not only presses the nozzle needle against the nozzle seat but also presses the sleeve against the throttle disk, which is thus held positionally fixed within the fuel injection valve. Here, it is preferable for the sleeve to have, at its end side facing the throttle disk, a sealing edge by way of which said sleeve bears sealingly against the throttle disk.

In a further advantageous refinement, the closing spring is arranged under compressive preload between a shoulder, which is formed in the interior of the sleeve by a step of the internal diameter, and a shoulder of the nozzle needle, which shoulder is formed by a step in the external diameter. This simple design permits a compact arrangement of the components and separate assembly of sleeve, spring and nozzle needle outside the nozzle body. For adjustment of the force of the closing spring, it is furthermore advantageously provided that a compensating disk is arranged between the closing spring and the shoulder of the nozzle needle, by means of the thickness of which compensating disk the preload force of the closing spring can be adjusted.

BRIEF DESCRIPTION OF THE INVENTION

Further advantages and advantageous refinements of the invention will emerge from the description and from the drawing.

Figure 2:
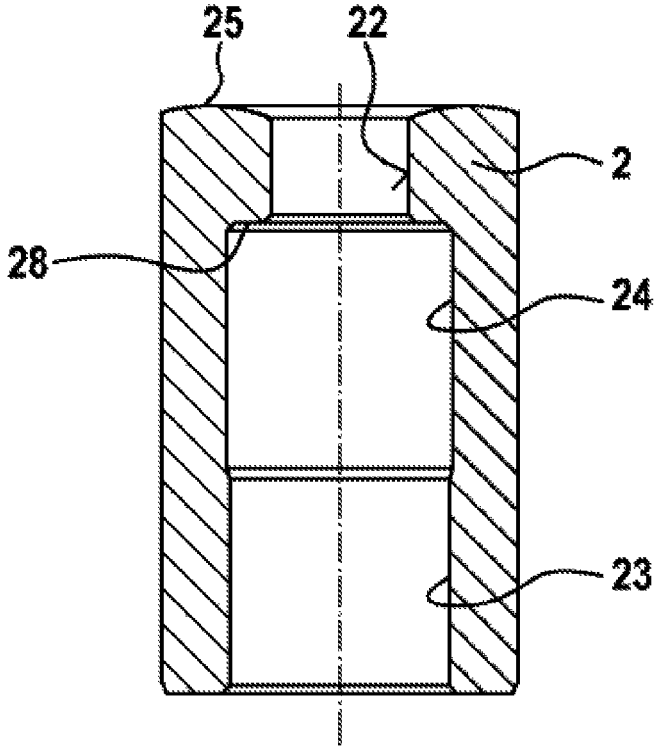

The drawing illustrates an exemplary embodiment of the fuel injection valve according to the invention. In the drawing:

FIG. 1 shows a longitudinal section through a fuel injection valve according to the invention, with only the main regions being illustrated, and FIG. 2 shows an enlarged illustration of the sleeve that delimits the control chamber.

DETAILED DESCRIPTION

FIG. 1 illustrates a fuel injection valve according to the invention in longitudinal section, with only the main regions being illustrated. The fuel injection valve comprises a nozzle body 1 and a throttle disk 2, which are clamped against one another by way of a clamping device (not illustrated). In the nozzle body 1 there is formed a pressure chamber 3 which can be charged with fuel at high pressure via a line which is not illustrated in the drawing. A piston-like nozzle needle 5 is arranged in longitudinally displaceable fashion in the pressure chamber 3, which nozzle needle is guided in a guide section 105, which as viewed in the longitudinal direction is formed approximately in the center of the pressure chamber 3, and in a guide section 205, which is close to the seat at the combustion chamber-side end of the pressure chamber 3. The nozzle needle 5, at its combustion chamber-side end, has a sealing surface 6 by means of which the nozzle needle 5 interacts with a nozzle seat 7 formed in the nozzle body 1, wherein both the sealing surface 6 and the nozzle seat 7 are substantially of conical form. At the combustion chamber-side end of the nozzle body 1, there are formed multiple injection openings 8 via which fuel can be introduced from the pressure chamber 3 into a combustion chamber of an internal combustion engine. Here, the nozzle needle 5 interacts with the nozzle seat 7 such that, when said nozzle needle is in contact with the nozzle seat 7, the injection openings 8 are closed off in liquid-tight fashion with respect to the pressure chamber 3, whereas, when the nozzle needle 5 has been lifted from the nozzle seat 7, fuel can be injected from the pressure chamber 3 through the injection openings 8 into a combustion chamber. To ensure the flow of fuel within the pressure chamber 3 in the direction of the injection openings 8, the nozzle needle 5 has multiple ground portions 10 which are formed in the region of the guide section 105 and in the region of the guide section 205 close to the seat, and which ensure that a flow cross section exists which ensures an unthrottled flow of the fuel within the pressure chamber 3 to the injection openings 8.

At the end averted from the combustion chamber, within the pressure chamber 3, there is arranged a sleeve 12 which, in a needle-guiding section 23, receives that end of the nozzle needle 5 which is averted from the nozzle seat. In this regard, FIG. 2 also shows a longitudinal section through the sleeve 12. Here, the sleeve 12, the nozzle needle 5 and the throttle disk 2 delimit a control chamber 20 which can be connected, via an outflow throttle 13 formed within the throttle disk 2 and via a control valve (not illustrated), to a low-pressure chamber, such that, by way of the control valve, a fluctuating fuel pressure can be set within the control chamber 20. A closing spring 16 is arranged under compressive preload within the control chamber 20, which closing spring surrounds a peg 14 which forms that end of the nozzle needle 5 which is averted from the nozzle seat. The closing spring 16 bears at one side against a shoulder 28 which is formed within the sleeve 12, and at the other side against a shoulder 18 which is formed at the transition of the peg 14 to the nozzle needle 5. The shoulder 28 formed within the sleeve 12 is realized by way of a step in the internal diameter of the sleeve 12, as shown in more detail in FIG. 2. The sleeve 12 has the needle-guiding section 23, a section 24 of widened diameter, and a bore 22, wherein the bore 22 has a smaller diameter than the widened section 24, such that the shoulder 28 is formed at the transition of the bore 22 to the widened section 24.

The shoulder 18 on the nozzle needle 5 is formed at the transition of the peg 14 to the rest of the nozzle needle 5, which has a greater diameter. Furthermore, a compensating disk 17 bears against the shoulder 18, which compensating disk is in the form of an annular disk and by means of the thickness of which compensating disk the preload of the closing spring 16 can be adjusted. To permit pressure equalization within the control chamber 20 without problems, there is formed between the peg 14 and the bore 22 a ring-shaped gap 27 which is of such a size that no pressure differences arise within the control chamber 20.

The mode of operation of the fuel injection valve is, as is already known from the prior art, such that the fuel pressure in the pressure chamber 3 and in the control chamber 20 at the start of the injection corresponds to the high fuel pressure made available by a fuel high-pressure accumulator. If it is the intention for an injection to be performed, the control chamber 20 is connected, via the outflow throttle 13 and the control valve (not illustrated), to a low-pressure chamber, such that the fuel pressure in the control chamber 20 falls. The nozzle needle 5 is thereupon pushed away from the nozzle seat 7 by the fuel pressure in the pressure chamber 3, such that the injection openings 8 are connected to the pressure chamber 3 and fuel is injected from the pressure chamber 3 via the injection openings 8 into a combustion chamber of the internal combustion engine. To end the injection, the control chamber 20 is flooded with fuel at high pressure again, such that the nozzle needle 5 slides back into its closed position again.

When the internal combustion engine is shut down, the pressure in the high-pressure accumulator falls, and thus after a certain time the pressure in the pressure chamber 3 of the fuel injection valve also falls, to a pressure which generally lies only slightly above ambient pressure. In this state, the nozzle needle 5 is substantially pressure-balanced in the longitudinal direction, that is to say it could be moved in the longitudinal direction without application of force. To prevent the possibility of the nozzle needle inadvertently opening up the injection openings in said state and fuel dripping into the combustion chamber, the closing spring 16 pushes the nozzle needle 5 into contact with the nozzle seat 7, and thereby closes the injection openings 8, even if the fuel injection valve and thus the pressure chamber 3 are unpressurized. For the actual operation of the fuel injection valve, that is to say for the longitudinal movement of the nozzle needle 5, the force of the closing spring 16 does not play a role or plays only a secondary role, because the hydraulic forces are greatly predominant in the presence of injection pressures of up to 2000 bar.

The sleeve 12, at its face side which is averted from the nozzle seat and by means of which it bears against the throttle disk 2, has a sealing edge 25 which is formed by two conical surfaces on the face side of the sleeve 12. The sleeve 12 bears by way of the sealing edge 25 against the throttle disk 2, such that effective and reliable sealing of the control chamber 20 with respect to the pressure chamber 3 is realized at that location. If the diameter of the sealing edge 25 substantially corresponds to the needle-guiding section 23 of the sleeve 12, the fuel pressure within the control chamber 20 does not give rise to any hydraulic forces on the sleeve 12, such that the latter remains in contact with the throttle disk 2 at all times, and reliably seals off the control chamber 20 at that location. The play between the nozzle needle 5 and the needle-guiding section 23 of the sleeve 12 is dimensioned such that, firstly, a longitudinal movement of the nozzle needle 5 is made possible without problems, but only very small amounts of fuel are exchanged between the pressure chamber 3 and the control chamber 20 through the remaining residual gap between the nozzle needle 5 and the needle-guiding section 23, which amounts are not of significance for the actual operation of the fuel injection valve.

The invention claimed is:

1. A fuel injection valve for internal combustion engines, the fuel injection valve comprising a nozzle body (1) having a pressure chamber (3) formed therein, wherein the pressure chamber (3) is configured to be charged with fuel at high pressure, and wherein a piston-like nozzle needle (5) is arranged in longitudinally displaceable fashion in the pressure chamber, which nozzle needle, by way of a sealing surface (6) formed on a combustion chamber-side end of the nozzle needle, interacts with a nozzle seat (7) formed in the nozzle body (1) and thereby controls a flow of fuel from the pressure chamber (3) to at least one injection opening (8), and the fuel injection valve comprising a sleeve (12) which receives an end of the nozzle needle (5) remote from the nozzle seat, which sleeve delimits a control chamber (20), a pressure of which exerts a hydraulic force on the nozzle needle (5) in a direction of the nozzle seat (7), characterized in that, in the control chamber (20), there is a closing spring (16) which is under compressive preload between the sleeve (12) and the nozzle needle (5);

wherein the closing spring (16) exerts a closing force on the nozzle needle (5) in the direction of the nozzle seat (7);

wherein the force of the closing spring (16) presses the sleeve (12) against a throttle disk (2) which delimits the control chamber (20);

wherein the closing spring is under compressive preload between a shoulder (28), which is formed in an interior of the sleeve (12) by a step of an internal diameter, and a shoulder (18) of the nozzle needle (5), which shoulder is formed by a step in an external diameter; and wherein the sleeve (12) has a needle-guiding section (23) in which the nozzle needle (5) is guided.

2. The fuel injection valve as claimed in claim 1, characterized in that the sleeve (12) has, at an end facing the throttle disk (2), a sealing edge (25) by way of which said sleeve bears sealingly against the throttle disk (2).

3. The fuel injection valve as claimed in claim 1, characterized in that a compensating disk (17) is arranged between the closing spring (16) and the shoulder (18) of the nozzle needle (5).

* * * * *